US007839344B2

(12) United States Patent
Marrocco et al.

(10) Patent No.: US 7,839,344 B2
(45) Date of Patent: Nov. 23, 2010

(54) WIDEBAND MULTIFUNCTION ANTENNA OPERATING IN THE HF RANGE, PARTICULARLY FOR NAVAL INSTALLATIONS

(75) Inventors: Gaetano Marrocco, Montecompatri (IT); Fernando Bardati, Rome (IT); Manlio Proia, Rome (IT); Piero Tognolatti, Rome (IT); Lorenzo Mattioni, Rome (IT); Raffaele Perelli, Ardea (IT); Giampiero Colasanti, Rome (IT); Giovanni Falcione, Rome (IT)

(73) Assignee: Selex Communications S.p.A., Genoa (IT)

( * ) Notice: Subject to any disclaimer, the term of this patent is extended or adjusted under 35 U.S.C. 154(b) by 192 days.

(21) Appl. No.: 11/914,634

(22) PCT Filed: May 18, 2006

(86) PCT No.: PCT/IB2006/051583

§ 371 (c)(1),
(2), (4) Date: Nov. 16, 2007

(87) PCT Pub. No.: WO2006/123311

PCT Pub. Date: Nov. 23, 2006

(65) Prior Publication Data

US 2008/0278407 A1 Nov. 13, 2008

(30) Foreign Application Priority Data

May 19, 2005 (IT) ..... TO2005A0344

(51) Int. Cl.
*H01Q 1/34* (2006.01)

(52) U.S. Cl. ..... 343/709; 343/749

(58) Field of Classification Search ..... 343/900, 343/866, 867, 868, 804, 709, 742, 745, 749
See application file for complete search history.

(56) References Cited

U.S. PATENT DOCUMENTS 4,652,888 A * 3/1987 Deasy ..... 343/791

(Continued)

FOREIGN PATENT DOCUMENTS

DE 40 27 234 A1 3/1992

*Primary Examiner*—HoangAnh T Le
(74) *Attorney, Agent, or Firm*—Seed IP Law Group PLLC

(57) ABSTRACT

A linear antenna for operation in the HF frequency range, particularly for naval communications is disclosed, comprising a radiating arrangement (H1, H2, H3, W1, W2), adapted to be operatively associated with a ground conductor (20) and at least one electrical impedance device (Z1-Z4), characterized in that it includes: a plurality of wire radiating elements with a predominantly vertical extension, forming a first and a second conducting branch (H1, H2) adapted to be operatively coupled to a feed circuit, and a return conducting branch (H3) adapted to be operatively coupled to a ground conductor (20); and a plurality of wire radiating elements with a predominantly transverse extension, forming connecting conducting branches (W1, W2) for connecting the conducting branches (H1, H2) adapted to be coupled to the feed circuit (12), to the conducting branch (H3) adapted to be coupled to the ground conductor (20), the radiating elements being positioned in such a way as to form, in a plane in which the antenna lies, two nested closed paths (P1, P2) between the feed circuit (12) and the ground conductor (20), having at least one radiating element in common, and—a plurality of electrical impedance devices (Z1-Z4) interposed along the conducting branches (H1, H2, H3, W1, W2) and adapted to impede the flow of current within corresponding predetermined frequency ranges in such a way as to establish selectively, according to the operating frequency, a plurality of different current paths along the conducting branches (H1, H2, H3, W1, W2), corresponding to a plurality of different electrical and/or geometrical configurations of the antenna (10).

32 Claims, 2 Drawing Sheets

U.S. PATENT DOCUMENTS

| | | | | |
|---|---|---|---|---|
| 5,014,068 | A | 5/1991 | Abramo | |
| 6,037,905 | A * | 3/2000 | Koscica et al. | 343/701 |
| 6,600,455 | B2 * | 7/2003 | Yamamoto et al. | 343/828 |
| 6,917,339 | B2 * | 7/2005 | Li et al. | 343/702 |
| 7,187,335 | B2 * | 3/2007 | Vincent | 343/722 |
| 7,358,911 | B2 * | 4/2008 | Vincent | 343/722 |
| 2003/0103011 | A1 * | 6/2003 | Rogers et al. | 343/749 |
| 2007/0132649 | A1 * | 6/2007 | Vincent | 343/749 |

* cited by examiner

WIDEBAND MULTIFUNCTION ANTENNA OPERATING IN THE HF RANGE, PARTICULARLY FOR NAVAL INSTALLATIONS

The present invention relates to a linear antenna, and in particular a wideband linear antenna for operation in the HF frequency range.

More specifically, the invention relates to an antenna of the type referred to in the preamble of Claim 1.

The field of radio communication systems development has recently seen the establishment of the "Software Radio" or "Software-defined Radio" technology, based on the software definition of the modulation waveforms of radio signals, where transmitting and receiving devices of a radio communication system respectively modulate and demodulate a signal by means of a computer.

The Software Radio technology is based on precise standards defined by the Software Communication Architecture (SCA) and is applicable to radio communication systems operating in the frequencies ranging from 2 MHz to 3 GHz (the HF, VHF and UHF bands), in multichannel and multiservice modes. This technology makes it possible to select the most convenient modulating waveform by retrieval from a library whose components are standardized in an equally rigorous way.

In the HF frequency range (2 MHz-30 MHz), conventionally used for naval communications, there are known so called "multichannel" transmission systems, which can be used to combine a plurality of transmission channels by using a single antenna or a reduced number of antennae. Multichannel systems are constructed with the aid of power amplifiers which can be independently assigned to different services or to a single channel.

The antennae used at present for HF band naval communications must not only meet the requirement of operating in a plurality of transmission channels through the frequency range of the band and allow links in the proximity of the horizon (surface wave or sea wave, for distances up to approximately 500 km), beyond the horizon (BLOS, Beyond Line of Sight, for distances of more than approximately 100 km) and at high angles of elevation (NVIS, Near Vertical Incidence Skywave), but must also be as compact as possible in order to be compatible with the available space on board naval units.

In present naval communication systems, this set of requirements is met by using multiple antennae having different configurations and operating in sub-bands with different frequencies. For example, "fan" antennae are used for links with high angles of elevation at frequencies in the range from 2 MHz to 8 MHz, and "twin/triple whip" antennae are used for sea wave and beyond the horizon communications at frequencies in the range from 10 MHz to 30 MHz.

Recently, there have been proposals for the use of wideband HF antennae, formed from linear (wire) conductors loaded with lumped and/or distributed impedances, having the typical radiation modes of "whip" antennae. However, these antennae are not of the multifunction type, in the sense that, although they are wideband antennae, they cannot provide all the functionality required by HF band naval communications, in other words sea wave, sky wave (NVIS) and beyond horizon (BLOS) communication.

The coexistence of a plurality of antennae for different communication services and modes not only requires a large amount of space, complicated supply networks and elaborate control systems in a ship, but also has the drawback of generating interferences which can degrade the expected performances of the individual antennae.

Finally, conventional solutions with wideband HF antennae meet an insuperable obstacle in the new requirements of Software Radio technology which does not permit antennae with different supply points, currently used in the known art for obtaining different configurations and radiation patterns.

The object of the present invention is to provide a wideband multifunction antenna for operating in the HF frequency range which is designed particularly for fixed installations on board naval units, and which makes it possible to construct a multifunction flexible multichannel radio communication system for naval communications using Software Radio technology.

To this aim, the invention proposes a linear antenna having the characteristics claimed in Claim 1.

Specific embodiments are defined in the dependent claims.

The antenna proposed by the present invention overcomes the limitations of the antenna systems of the known art as a result of the special configuration of the radiating wire elements, which form an antenna of the "bifolded" type, i.e. with a design doubly folded, and as a result of the arrangement of the electrical impedance devices, which create a multifunction antenna, in other words one that can be configured according to the operating frequency.

According to the reciprocity theorem, the behaviour and characteristics of an antenna remain unchanged, regardless of whether it is used as a receiving or transmitting antenna, and therefore in the present description the operation of a transmitting antenna is considered and the definition of some characteristics makes reference to this for the sake of clarity, without excluding the use of the device in reception.

Briefly, the antenna proposed by the invention is characterized by the provision of a pair of powered conducting branches and a return conducting branch connected to a ground conductor (plane), having a predominantly vertical configuration, in which each powered branch is connected to the return branch through a corresponding conducting branch of predominantly horizontal configuration, so as to form two closed nested coplanar paths having one or more radiating elements in common. Such an arrangement makes it possible to provide a multiplicity of current paths of the "loop" and "monopole" type by convenient selection of the radiating elements of the antenna.

In detail, it is possible to obtain a radiation mode typical of a "whip" antenna for omnidirectional communication at low and medium angles of elevaton, a radiation mode typical of a "loop" antenna for communication at high angles of elevation, and a radiation mode typical of a "meander" antenna to simplify the miniaturization of the antenna for the purposes of communication at low and medium angles of elevation.

The selection of one of the aforesaid configurations occurs automatically and is dependent on the different frequency sub-bands of the HF range and is carried out as a result of the behaviour of the electrical impedance devices, made in the form of lumped constant two-terminal circuits, preferably two-terminal LC circuits in series or parallel resonant configurations, which act as bandpass or bandstop filters for the current flowing in the radiating elements of the antenna.

The electrical impedance devices make it possible to selectively modify the flow of currents in the conducting branches at the different frequencies (thus in accordance with the type of service), while simultaneously acting as an adaptation circuit distributed along the antenna.

Advantageously, the proposed configuration is able to produce sufficiently uniform radiation at different angles of elevation for the whole HF frequency range, and can therefore be justifiably described as a multifunction antenna, since the same device can be used simultaneously to cover all the required services in the HF band, in other words sea wave and near-vertical ionospheric reflection (NVIS) communication at the lower frequencies (2 MHz-4 MHz) and for short distances (up to 150 km), sea wave and ionospheric reflection communication at low frequencies (2 MHz-7 MHz) and for distances up to 500 km, ionospheric reflection communication for medium distances (1000/2000 km) at medium frequencies (6 MHz-15 MHz) and finally communications at low and medium angles of elevation (5-30 degrees) at the higher frequencies (15 MHz-30 MHz), without the need for any mechanical modification or reconfiguration of the antenna or of the feed circuit.

Advantageously, the two-terminal impedance circuits are purely reactive two-terminal circuits, making it unnecessary to provide dissipation systems remotely from the ground plane.

The antenna proposed by the present invention can withstand high transmission powers, of the order of several kW.

It can be used as a multifunction wideband antenna as defined above with a standing wave ratio of less than 3:1 over the whole HF band, and has a radiation efficiency of less than 50% in the frequency range from 2 MHz to 7 MHz and approximately 50-80% in the frequency range from 7 MHz to 30 MHz.

Further characteristics and advantages of the invention will be disclosed more fully in the following detailed description of one embodiment of the invention, provided by way of example and without restrictive intent, with reference to the attached drawings, in which.

Figure 1:
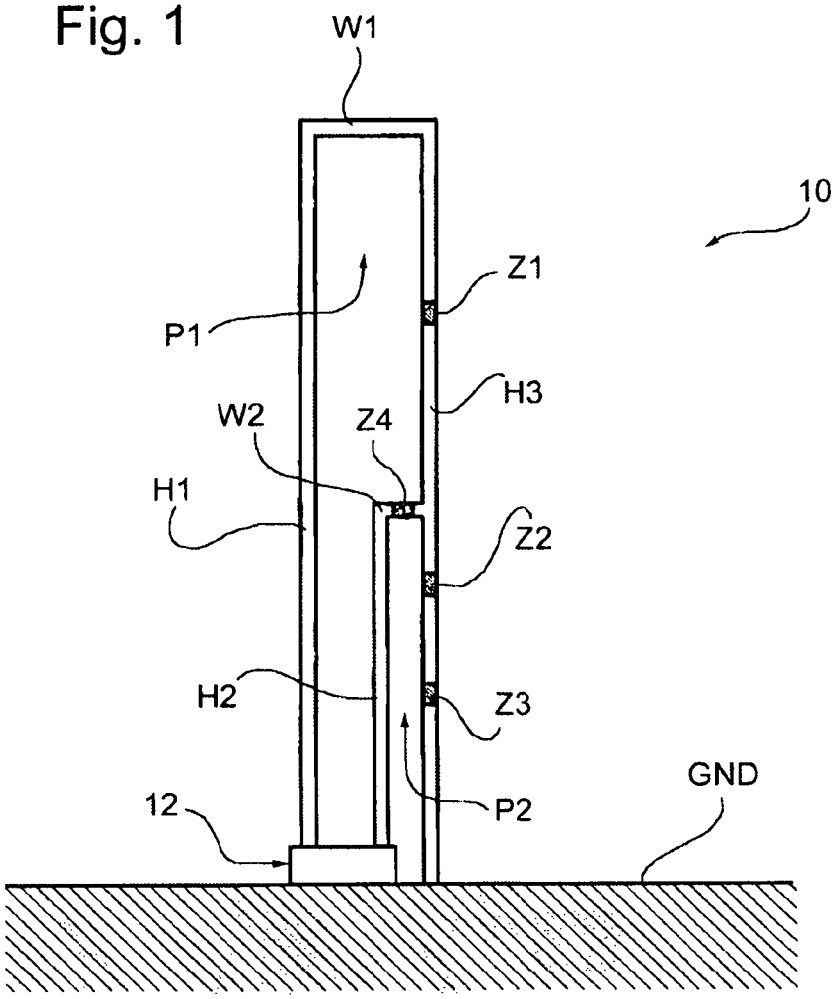
FIG. 1 is a schematic illustration of the antenna proposed by the invention.

A wideband multifunction antenna proposed by the invention, for operation in the HF frequency range (2 MHz-30 MHz), is indicated in its entirety by the number 10. In the figure, it is shown in a configuration of installation for use as a transmitting antenna, connected to a feed unit 12 and to a ground plane GND.

As mentioned in the introductory part of this description, according to the reciprocity theorem the behaviour and characteristics of the antenna remain unchanged regardless of whether it is used as a receiving or a transmitting antenna. Purely by way of illustration and without restrictive intent, the following part of the description will relate to the operation of a transmitting antenna, for the sole purpose of defining in the clearest and most appropriate way the characteristics of the radio frequency signal feed circuit.

The overall dimension of the antenna is predominantly vertical and it is preferably mounted on a horizontal ground plane, for example a surface of a ship.

The radiating arrangement of the antenna comprises wire radiant elements with a predominantly vertical extension and wire radiant elements with a predominantly transverse extension, all these elements being coplanar.

The radiant elements with a predominantly vertical extension form a first and second vertical conductor branch. H1 and H2, connected to corresponding terminals of the feed unit 12, and a third return conducting branch H3 connected to the ground plane GND.

The first fed conducting branch H1 and the return conducting branch H3 are connected by a first transverse conducting branch W1 and form a first closed rectangular path P1 between the feed unit and the ground plane. The second fed conducting branch H2 is connected to the return conducting branch H3 at an intermediate point of the branch H3 via a second transverse conducting branch W2, and forms a second closed rectangular path P2 between the feed unit and the ground plane.

Thus, the overall geometric configuration of the radiating arrangement of the antenna comprises a pair of nested paths P1, P2, having a portion of the return conducting branch H3 in common, and the antenna is therefore called "bifolded".

In the currently preferred embodiment, the vertical overall dimension of the antenna (in other words, the height of the conducting branches H1 and H3) is between approximately 8% and 10% of the maximum wavelength in the HF band (150 meters at the 2 MHz frequency), and is preferably 12 meters.

The overall horizontal dimension is between approximately 1% and 2% of the maximum wavelength in the HF band (150 meters at the 2 MHz frequency), and is preferably 2 meters.

The height of the vertical conducting branch H2 is between approximately 4% and 5% of the maximum wavelength in the HF band, and is preferably 6 meters, equal to half the height of the branches H1 and H3.

The diameter of the radiating elements forming the conducting branches is approximately 0.06%-0.07% of the maximum wavelength in the HF band, and preferably 0.1 m.

Conveniently, the length of the transverse conducting branch W2 is 0.8 meters, and therefore the inner rectangular path P2 has sides whose dimensions are approximately half of the dimensions of the sides of the outer rectangular path P1.

Electrical impedance devices Z1, Z2 and Z3 are interposed along the conducting branch H3, and a further impedance device Z4 is interposed along the transverse conducting branch W2.

Preferably, the impedance device Z1 comprises a reactive two-terminal circuit such as a series resonant LC circuit, while each of the impedance devices Z2, Z3 and Z4 comprises a two-terminal reactive circuit such as a parallel resonant LC circuit.

The electrical parameters of the impedance devices are such that they form lumped filter circuits adapted to selectively impede the propagation of electric current along the conducting branches in which they are connected, in corresponding sub-bands of the HF frequency range.

In the preferred embodiment, the impedance devices Z1, Z2 and Z3 are positioned, respectively, at heights of 9 meters, 5 meters and 3.4 meters above the ground plane GND, while the impedance device Z4 is positioned at 0.2 meters from the vertical axis of the return conducting branch H3.

In the exemplary embodiment described here, the electrical parameters of inductance and capacitance of the two-terminal LC circuits forming the impedance devices Z1-Z4 have the following values:

- the two-terminal circuit Z1 (series LC) has an inductive component of 0.21 μH and a capacitive component of 17 pF;
- the two-terminal circuit Z2 (parallel LC) has an inductive component of 1.39 μH and a capacitive component of 975 pF;
- the two-terminal circuit Z3 (parallel LC) has an inductive component of 2.36 μH and a capacitive component of 32 pF; and
- the two-terminal circuit Z4 (parallel LC) has an inductive component of 2.45 μH and a capacitive component of 24 pF.

Clearly, a person skilled in the art will be able to depart from the design data cited above which relate to the currently preferred embodiment, by providing a greater or a smaller number of impedance devices than that specified, provided that the devices are positioned along the conducting branches in such a way as to selectively control the coupling of the fed branches H1 and H2 to the ground conductor (plane) by their filtering action, and more specifically in such a way as to disconnect the fed branches from the ground conductor (plane) alternatively or simultaneously.

Figure 2:
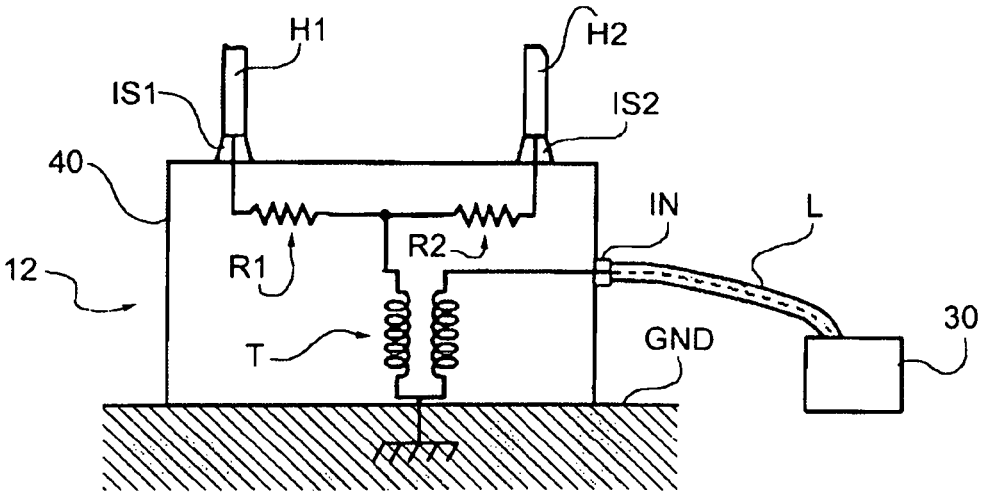
FIG. 2 is a schematic illustration of a feed circuit for the antenna of FIG. 1.

The feed unit 12 includes a signal adaptation and distribution circuit, such as that shown in FIG. 2.

The unit 12 is operatively positioned at the base of the antenna and electrically connected between the conducting branches H1 and H2 of the antenna and a transmission line for carrying a radio frequency signal.

With reference to a transmission arrangement, the feed unit 12 has an input IN coupled to a radio frequency signal source 30 via a transmission line L, such as a coaxial cable, and a pair of output ports OUT1, OUT2, in which the vertical conducting branches H1 and H2 of the antenna are fitted with the use of insulators IS1 and IS2.

The feed unit includes an impedance step-up transformer T—having a predetermined ratio n—referred to ground, having one terminal connected to the input IN for receiving the radio frequency signal, and the other terminal connected to a common node of a pair of impedance matching resistors R1, R2, which in turn are connected to the output ports OUT1 and OUT2.

The feed unit which has been described can be enclosed in a boxlike metal container 40, forming an electrical screen and connected to the ground plane GND. This forms a 50 ohm matching unit for the incoming transmission line.

Preferably, the resistance value of the resistors R1 and R2 are 100 ohms and 50 ohms respectively, and the impedance transformation ratio is 4.

In terms of operation, the antenna proposed by the invention acts as described below.

As an aid to understanding, FIGS. 3*a*-3*f* show radiation patterns at different frequencies, at planes $\phi=0°$ (solid lines) and $\phi=90°$ (broken lines).

A radio frequency signal emitted from the external source 30 and carried along the transmission line L is applied to the impedance transformer T and is distributed by the resistors R1 and R2 between the two outputs OUT1 and OUT2 of the feed unit 12, connected to the conducting branches H1 and H2 of the antenna, the distribution being carried out selectively as a function of the frequency and therefore of the type of function required from the antenna, according to the configuration determined by the behaviour of the impedance devices.

At low frequencies, for example 2-3 MHz, and preferably in the range from 2 to 4 MHz, the impedance device Z1 intervenes to impede the flow of current between the branch H1 and the ground plane GND, as a result of which the current in the antenna flows through the conducting branch H1 and the inner closed path P2, along the conducting branch H2, the conducting branch W2 and the lower half of the conducting branch H3. Thus the antenna has a dipole configuration of the "meander" type, which contributes to the omnidirectional radiation at low and medium angles of elevation, combined with a half-loop configuration (path P2) with radiation at high angles of elevation. In this case, the antenna is suitable for sea wave and NVIS communications.

Figure 3A:
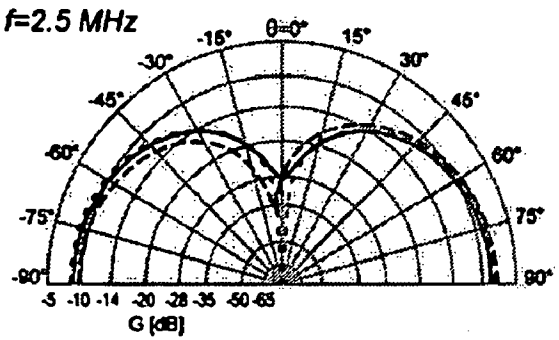
FIGS. 3*a*-3*f* represent the radiation patterns at different frequencies included in the HF band.

FIG. 3*a* shows the radiation pattern of the antenna at the frequency of 2.5 MHz, compared with that of an ideal monopole (the shorter broken lines forming symmetrical lobes).

Figure 3B:
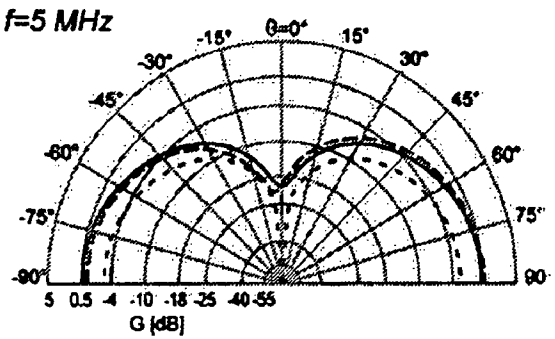
Figure 3C:
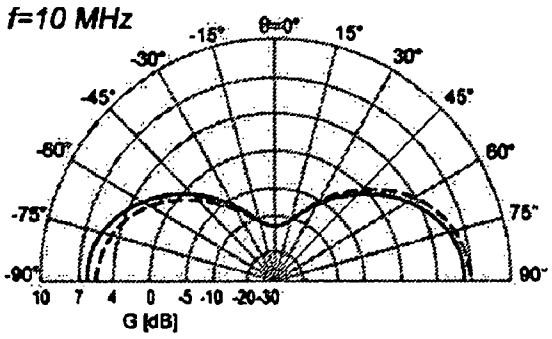
Figure 3D:
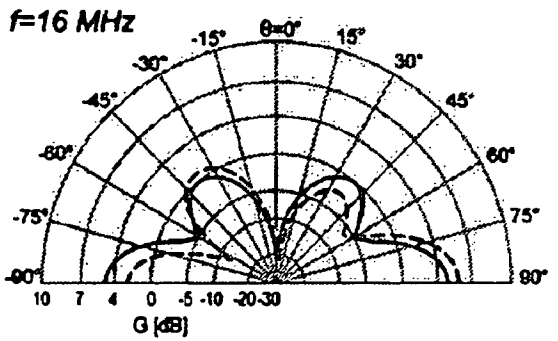

In the 4-10 MHz range, at 5 MHz for example, the impedance device Z4 impedes the flow of current between the branch H2 and the ground plane GND, and therefore the current in the antenna is mainly distributed along the inverted U-shaped outer path P1, which includes the conducting branches H1, W1 and H3. Thus the antenna has the conventional folded monopole configuration with an omnidirectional radiation pattern in the azimuthal plane, and a gain which is maximum for low and medium angles of elevation and which is not negligible near the vertical. FIG. 3*b* shows the corresponding radiation pattern, compared with that of an ideal monopole (the shorter broken lines, forming symmetrical lobes).

In this case also, the antenna is suitable for sea wave and NVIS communications.

At the medium frequencies (preferably in the 10 MHz-20 MHz range) the impedance devices Z2 and Z3 combine to impede the flow of current in the lower portion of the conductor H3, thus establishing non-closed "P"-shaped current paths which include the conducting branches H1, W1, H2, W2 and the upper half of the conducting branch H3. The configuration of the antenna and the corresponding radiation mode (radiation patterns in FIGS. 3*c* and 3*d*) are therefore similar to those of a "whip" antenna, which has an omnidirectional radiation pattern at low and medium angles of elevation, and is suitable for sea wave and BLOS communications.

Figure 3E:
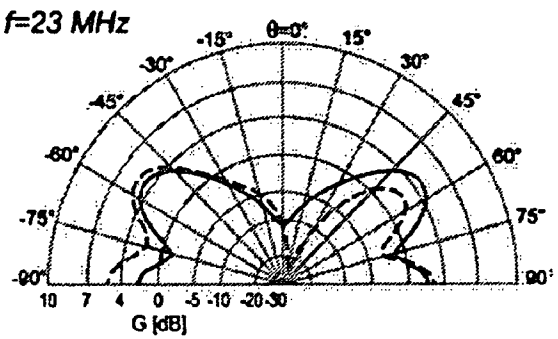
Figure 3F:
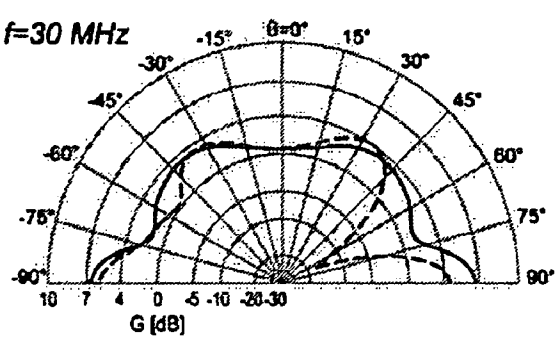
Figure 3F:
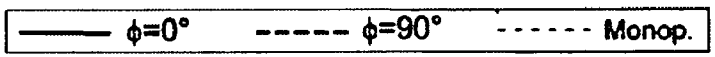

Finally, at the higher frequencies the antenna has radiation patterns of the type shown in FIGS. 3*e* and 3*f* and a good gain at low radiation angles.

It should be noted that the embodiment of the present invention proposed in the preceding discussion is purely exemplary and is not restrictive. A person skilled in the art could easily apply the present invention in different embodiments based on the principle of the invention. This is particularly true of the possibility of positioning the predominantly vertical conducting branches in a direction inclined with respect to the vertical, in such a way as to form an overall "A" configuration, or making the transverse conducting branches in the form of non-rectilinear branches, of curved shape for example, to increase the mechanical stability of the antenna structure.

Additionally, and again in order to impart greater stability to the overall structure of the antenna, while keeping all the radiating elements of the antenna in a single plane, the elements do not necessarily have to lie in a vertical plane with respect to the ground plane, but can be positioned in an inclined plane, supported if necessary by stays or similar supporting structures.

Clearly, provided that the principle of the invention is retained, the forms of application and the details of construction can therefore be varied widely from what has been described and illustrated purely by way of example and without restrictive intent, without departure from the scope of protection of the present invention as defined by the attached claims.

The invention claimed is:

1. A linear antenna, comprising:

a first plurality of wire radiating elements extending predominantly in a first direction and forming:

a first conducting branch having a connection configured to receive radio frequency signals;

a second conducting branch having a connection configured to receive radio frequency signals; and a return conducting branch having a connection configured to couple to a reference voltage;

a second plurality of wire radiating elements forming connecting conducting branches between the first and second conducting branches and the return conducting branch, the first and second pluralities of radiating elements are configured to form, in a plane of the antenna, two nested paths between the respective connections of the first and second branches and the connection of the return branch, the paths having at least one radiating element in common; and a plurality of electrical impedance devices interposed along the conducting branches and configured to impede flow of current within selected frequency ranges to establish selectively, according to an operating frequency, a plurality of different current paths along the conducting branches corresponding to a plurality of different electrical and/or geometrical configurations of the antenna.

2. The linear antenna of claim 1 wherein the two paths have at least part of the return conducting branch in common.

3. The linear antenna of claim 1 wherein the conducting branches form, in an operating arrangement of the antenna, a vertical plane in which the antenna lies.

4. The linear antenna of claim 1 wherein the first conducting branch, the second conducting branch and the return conducting branch extend parallel to each other in a vertical direction.

5. The linear antenna of claim 4 wherein the connecting conducting branches extend in a horizontal direction between the the first conducting branch, the second conducting branch and the return conducting branch in such a way that the two nested paths have a rectilinear shape.

6. The linear antenna of claim 5 wherein a vertical extension of the antenna is between 8% to 10% of a maximum wavelength in a high-frequency band.

7. The linear antenna of claim 6 wherein a horizontal extension of the antenna is between 1% to 2% of the maximum wavelength in the high-frequency band.

8. The linear antenna of claim 7 wherein an inner path of the two rectilinear paths has sides whose dimension is half of a dimension of corresponding sides of an outer path of the two rectilinear paths.

9. The linear antenna of 1 wherein the electrical impedance devices are two-terminal reactive circuits with lumped parameters.

10. The linear antenna of claim 9 wherein the two-terminal reactive circuits comprise parallel resonant LC circuits.

11. The linear antenna of claim 9 wherein the two-terminal reactive circuits comprise series resonant LC circuits.

12. The linear antenna of claim 1 wherein the plurality of impedance devices comprises at least one first impedance device in an outer path of the two paths, and having electrical parameters such that the at least one first impedance device impedes a flow of current in a first frequency range, being arranged to create in the first frequency range a current path comprising, separately, the first conducting branch and the second conducting branch connected to the return conducting branch, so that the antenna takes a dipole configuration.

13. The linear antenna of claim 12 wherein the plurality of impedance devices comprises at least one second impedance device in an inner path of the two paths, and having electrical parameters such that the at least one second impedance device impedes a flow of current in a second frequency range, being arranged to create in the second frequency range a current path comprising the first conducting branch connected to the return conducting branch, so that the antenna takes a folded monopole configuration.

14. The linear antenna of claim 13 wherein the plurality of impedance devices comprises at least one third impedance in a portion of the return conducting branch common to both paths and having electrical parameters such that the at least one third impedance device impedes a flow of current in a third frequency range, being arranged to create in the third frequency range a current path comprising the first and the second conducting branch connected to each other, so that the antenna takes a whip configuration.

15. The linear antenna of claim 1 where the plurality of impedance devices are configured to form a distributed impedance matching circuit for each configuration of the antenna.

16. A system, comprising:

a linear antenna, having:

a first plurality of radiating elements extending predominantly in a first direction and forming:

a first conducting branch;

a second conducting branch; and a return branch coupled to a ground;

a second plurality of radiating elements forming connecting branches between the first and second conducting branches and the return branch; and a plurality of electrical impedance devices interposed along the branches; and a radio-frequency signal matching and distribution unit coupled to the first and second conducting branches and having:

an impedance step-up transformer circuit coupled to the ground and between a signal transmission line and the conducting branches; and a pair of impedance matching resistors interposed between the transformer circuit and the conducting branches, wherein the first and second pluralities of radiating elements are configured to form, in a plane of the antenna, a plurality of nested paths between respective connections of the first and second branches to the radio-frequency signal matching and distribution unit and a connection of the return branch to the ground, the paths having at least one radiating element in common, and the plurality of electrical impedance devices are configured to impede current flow within selected frequency ranges to establish selectively, according to an operating frequency, current paths along the branches corresponding to a plurality of different electrical and/or geometrical configurations of the antenna.

17. The system of claim 16 wherein the plurality of paths have at least part of the return branch in common.

18. The system of claim 16 wherein the first conducting branch and the return branch form a first, outer path of the plurality of paths, and the second conducting branch and the return branch form a second, inner path of the plurality of paths, the two paths having at least part of the return conducting branch in common.

19. A linear antenna, comprising:

a first plurality of radiating elements extending predominantly in a first direction and configured to form:

a first conducting branch having a connection configured to receive radio frequency signals;

a second conducting branch having a connection configured to receive radio frequency signals; and a return branch having a connection configured to couple to a ground;

a second plurality of wire radiating elements configured to form:

a first connecting branch coupled between the first conducting branch and the return branch, wherein the first conducting branch, the first connecting branch and the return branch form an outer path; and a second connecting branch coupled between the second conducting branch and the return branch, wherein the second conducting branch, the second connecting branch and the return branch form an inner path nested in the outer path, the outer and inner paths having at least part of the return branch in common; and a plurality of electrical impedance devices interposed along the branches and configured to impede current flow within selected frequency ranges to establish selectively, according to an operating frequency, a plurality of different current paths along the branches corresponding to a plurality of different electrical and/or geometrical configurations of the antenna.

20. The linear antenna of claim 19 wherein the branches form, in an operating arrangement of the antenna, a vertical plane in which the antenna lies.

21. The linear antenna of claim 19 wherein the first branch, the second conducting branch and the return branch extend parallel to each other in a vertical direction.

22. The linear antenna of claim 21 wherein the connecting branches extend in a horizontal direction between the the first conducting branch, the second conducting branch and the return branch, and the two paths have a rectilinear shape.

23. The linear antenna of claim 22 wherein a vertical extension of the antenna is between 8% to 10% of a maximum wavelength in a high-frequency band.

24. The linear antenna of claim 23 wherein a horizontal extension of the antenna is between 1% to 2% of the maximum wavelength in the high-frequency band.

25. The linear antenna of claim 24 wherein the inner path of the two rectilinear paths has sides whose dimension is half of a dimension of corresponding sides of the outer path.

26. The linear antenna of 19 wherein the electrical impedance devices are two-terminal reactive circuits with lumped parameters.

27. The linear antenna of claim 26 wherein the two-terminal reactive circuits comprise parallel resonant LC circuits.

28. The linear antenna of claim 27 wherein the two-terminal reactive circuits comprise series resonant LC circuits.

29. The linear antenna of claim 19 wherein the plurality of impedance devices comprises at least one first impedance device in the outer path configured to impede current flow in a first frequency range and create in this frequency range a current path comprising, separately, the first conducting branch and the second conducting branch connected to the return branch, so that the antenna takes a dipole configuration.

30. The linear antenna of claim 29 wherein the plurality of impedance devices comprises at least one second impedance device in the inner path configured to impede current flow in a second frequency range and create in the second frequency range a current path comprising the first conducting branch connected to the return branch, so that the antenna takes a folded monopole configuration.

31. The linear antenna of claim 30 wherein the plurality of impedance devices comprises at least one third impedance device in a portion of the return branch common to both paths and configured to impede current flow in a third frequency range and create in the third frequency range a current path comprising the first and the second conducting branch connected to each other, so that the antenna takes a whip configuration.

32. The linear antenna of claim 19 where the plurality of impedance devices are configured to form a distributed impedance matching circuit for each configuration of the antenna.

* * * * *